US006854565B2

(12) United States Patent
Peräläet al.

(10) Patent No.: US 6,854,565 B2
(45) Date of Patent: Feb. 15, 2005

(54) METHOD FOR MONITORING THE DOOR MECHANISM OF AN ELEVATOR

(75) Inventors: Pekka Perälä, Helsinki (FI); Riitta Partanen-Jokela, Hyvinkää (FI); Seppo Suur-Askola, Riihimäki (FI); Pekka Torenius, Röykkä (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 10/417,205

(22) Filed: Apr. 17, 2003

(65) Prior Publication Data

US 2003/0217894 A1 Nov. 27, 2003

Related U.S. Application Data

(63) Continuation of application No. PCT/FI01/00867, filed on Oct. 8, 2001.

(30) Foreign Application Priority Data

Oct. 30, 2000 (FI) ..... 20002390

(51) Int. Cl.[7] ..... B66B 3/00
(52) U.S. Cl. ..... 187/393; 187/316; 187/247
(58) Field of Search ..... 187/316, 247, 187/391, 393, 248, 313, 317, 284, 291; 340/506, 507, 514, 825.06, 825.02; 49/25, 26, 30, 31

(56) References Cited

U.S. PATENT DOCUMENTS

| | | | | |
|---|---|---|---|---|
| 4,512,442 A | | 4/1985 | Moore et al. | |
| 4,750,591 A | * | 6/1988 | Coste et al. | 187/391 |
| 4,930,604 A | * | 6/1990 | Schienda et al. | 187/393 |
| 5,760,350 A | | 6/1998 | Pepin et al. | |
| 6,330,935 B1 | * | 12/2001 | Systermans | 187/391 |
| 6,330,936 B1 | * | 12/2001 | Lence Barreiro et al. | 187/393 |
| 6,392,537 B1 | * | 5/2002 | Tazumi et al. | 340/507 |
| 6,439,350 B1 | * | 8/2002 | Lence Barreiro et al. | 187/391 |
| 2003/0121730 A1 | * | 7/2003 | Liu et al. | 187/391 |

FOREIGN PATENT DOCUMENTS

| | | |
|---|---|---|
| EP | 0 776 855 A1 | 6/1997 |
| EP | 0 845 433 A1 | 6/1998 |
| WO | WO 02/36476 A1 | 5/2002 |

* cited by examiner

*Primary Examiner*—Jonathan Salata
(74) *Attorney, Agent, or Firm*—Birch, Stewart, Kolasch & Birch, LLP

(57) ABSTRACT

The invention relates to a method for monitoring the condition of the door of an elevator and determining its need for maintenance, the door comprising a door mechanism, door panels and a door operator. The signals (10) of the control system of a door in good condition are measured and a set of characteristics descriptive of the operation of the door is generated from them. The signals (10) of the door control system are measured the operation during the opening and closing movements of the door is divided into stages according to which parts of the door are functioning at each stage. From the measured signals (10), a set of characteristics descriptive of the operation of the door is generated. The set of characteristics thus generated is compared to the set of characteristics for a normal operating condition stored in memory, at least in one stage of operation. Based on the comparison of the two sets of characteristics, a diagnosis is performed to determine where and how the operation of the door and its components deviates from normal operation, and the result of the diagnosis is utilized to establish the need for servicing and a servicing date.

19 Claims, 3 Drawing Sheets

METHOD FOR MONITORING THE DOOR MECHANISM OF AN ELEVATOR

This application is a continuation or copending PCT International Application No. PCT/FI01/00867 filed on Oct. 8, 2001, which was published in English and which designated the United States and on which priority is claimed under 35 U.S.C. §120, the entire contents of which are hereby incorporated by reference.

FIELD OF THE INVENTION

The present invention relates to a method as defined in the preamble of claim 1 for monitoring the condition of an elevator door and determining its need for maintenance.

DESCRIPTION OF THE BACKGROUND ART

The purpose of preventive maintenance of an elevator door is to reduce the degradation of its condition and performance caused by environmental effects, use and wear. Environmental factors and heavier-than-anticipated use accelerate the wear of the door and may lead to failures. For example, transporting bulky and heavy objects on an elevator designed for passenger service may result in fastenings becoming loose, changes in adjustments and deterioration of the quality of door operation. Dust, dirt and temperature are environmental factors affecting the condition of the installation and the speed of the degradation process. If timely servicing of the elevator doors is neglected, failure of the doors may result so that passengers can no longer use the elevator at all or the quality of operation of the elevator falls decisively, e.g. the doors produce too much noise when operated or their operation becomes slower. Unexpected faults that stop elevator operation arise e.g. from failures of electronic components and from vandalism. The scheduling of preventive maintenance is conventionally based either on regular servicing at certain intervals or on the extent of utilization, for example on the cumulative number of times the door has been opened and closed.

E.g. in patent U.S. Pat. No. 4,512,442 Moore et al., known systems are used to count the number of times the doors are opened and closed and send the number to a maintenance center for scheduling of servicing. Scheduling based on extent of utilization can be adjusted by considering the type of the building. Some more advanced prior-art methods additionally utilize data from the operation history of the elevators.

Previously known methods do not take into account the individual wear of elevators resulting from changing environmental factors and occasional rough treatment. Elevator operation history data may be used for this purpose, but in this case the scheduling of maintenance will change very slowly. Earlier methods are also unable to focus maintenance and repair actions clearly on different parts of the door system.

Servicing visits for maintenance and repair of elevators have been scheduled on the basis of either client notifications about deterioration of elevator condition or on the basis of failure reports sent by automatic monitoring systems. Conventional methods of monitoring elevator doors are based on making inferences from events and status. In event-based monitoring, the sequences of occurrence of open, reopened, closed and locked states of the elevator door are observed using on/off-type signals obtained from sensors; this is the mode of operation of e.g. the open and closed limit switches of the door. The monitoring system is able to distinguish abnormal sequences of events or aberrant timings. By these methods, the need for maintenance can only be determined on a rough level, typically in terms of either/or data. Generally, a need for maintenance is only detected when elevator operation has stopped completely because of a defective door. The need for maintenance cannot be specified for particular components of the door system. Occurrences evoked by elevator users and resembling a failure cannot be distinguished from real failures; for instance, passengers intentionally obstruct the closing movement of the door by utilizing the safety equipment of the door.

BRIEF SUMMARY OF THE INVENTION

The object of the present invention is to eliminate the above-mentioned disadvantages. The method of the invention Monitors the condition of the door mechanism of an elevator and determines its need for maintenance.

Advantages:

- in the determination of the need for preventive maintenance, specific and changing environmental conditions of individual elevators and the effects of occasional rough treatment are taken into account,
- degradation of the condition of the elevator door can be measured on a continuous scale taking even minor changes into account, thus providing flexibility in the scheduling of a servicing visit,
- in some cases the system is able to forecast an ultimate date by which the system has to be serviced in order to keep it operative
- the need for maintenance and repair can be specified for particular sub-systems of the door system
- it is not necessary to install a separate sensor on the door; instead, the system is able to utilize internal control signals of the door control system,
- the method can be used to measure the quality of the lateral movement of the elevator door.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following, the invention will be described in detail by the aid of examples with reference to the attached drawings, which are given by way of illustration only, and thus are not limitative of the present invention, and wherein.

DETAILED DESCRIPTION OF THE INVENTION

Figure 1:
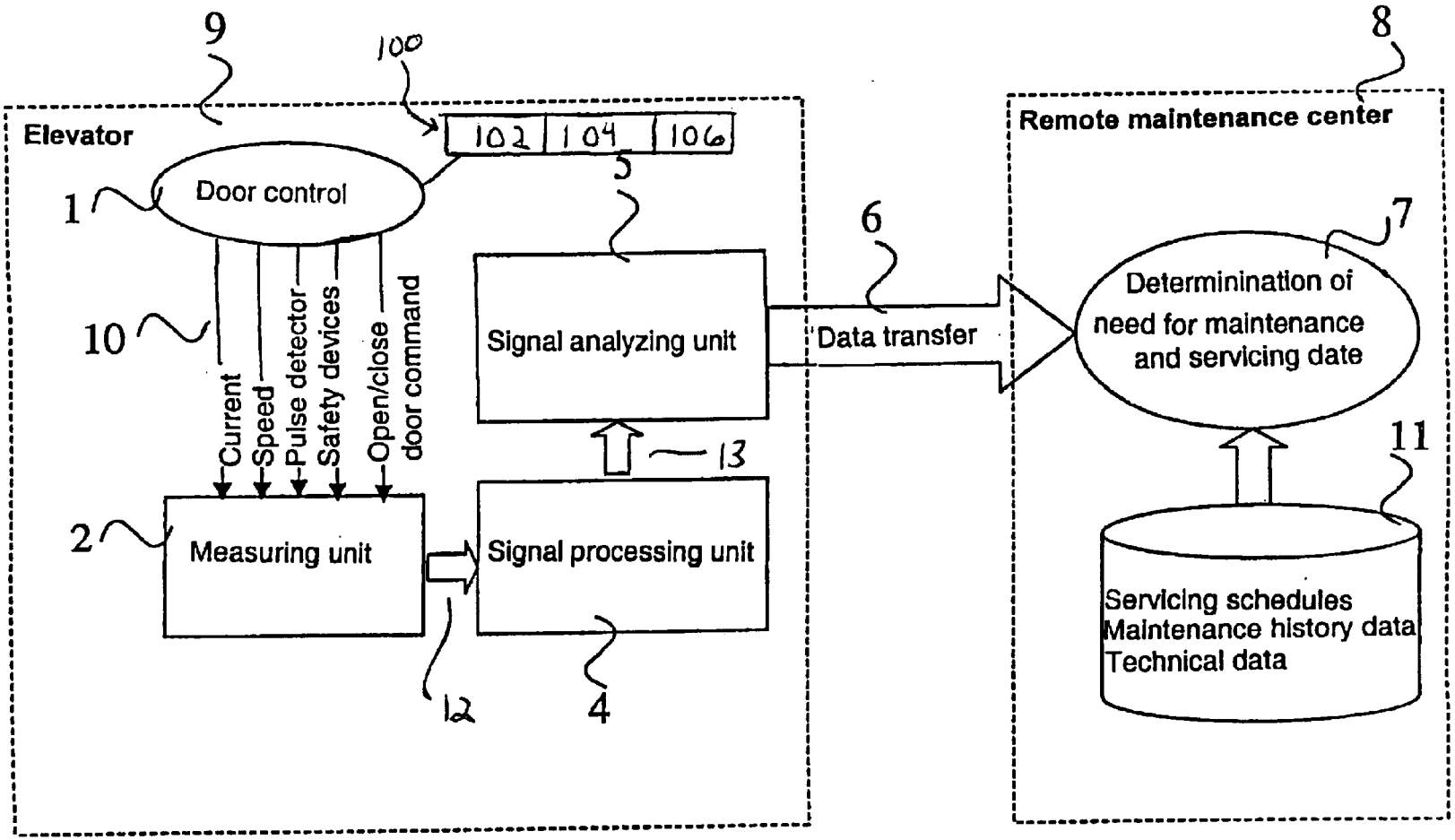
FIG. 1 presents an embodiment of a door mechanism.

FIG. 1 shows how the condition of an elevator door is monitored by measuring and analyzing internal signals 10 of the door control system. A door control unit 1 comprises a door control computer, which contains a regulator controlling a door operator. The door operator is a device that actuates the mechanical parts of the door. The door operator contains a control computer, control electronics, a motor and a power transmission system. In FIG. 1, the door mechanism 100 includes the door actuating system 102, the door panels or car door 104 and the door operator 106. A measuring unit 2 measures either directly or via the door control system the magnitude of the current used for door control as well as other door control signals, door speed and exact door position data. In a signal processing unit 4, a set of characteristics descriptive of door performance is generated from the measured signals 10. The characteristics are generated by distinguishing from the measured signal 10 e.g. amplitudes corresponding to certain frequency bands or frequencies or by observing the signal amplitude in the time domain. Frequency band refers to a limited range of frequencies for which a lower and an upper limit have been defined. The range comprises all frequencies between those limits. For example, the range 20 Hz –100 Hz is a frequency band.

In the system presented in FIG. 1, a signal analyzing unit 5 is placed in the elevator 9, but alternatively it may be built in the door operator or in a remote maintenance center 8. On the basis of exact door position data and the door commands, the system knows exactly the current phase of the opening or closing movement of the door. The values of the characteristics at different stages of a normal opening and closing movement are stored in a memory placed in the door system or in some other suitable location. The set of characteristics generated from the measurement is compared to a set of characteristics representing a normal operating condition. Normal operating condition or good elevator condition refers to an elevator that has been newly built or newly serviced and functions normally. From the characteristics, a diagnosis is produced using either rules programmed by an expert or computationally more demanding methods, depending on the computing capacity available. When there are several measured signals 10, such as current, speed, pulse detector, safety devices, open/close door command and external accelerometer, it will be possible to produce a more reliable definition of the door condition and the need for maintenance and repair can be defined more specifically than using a single measured signal. The data transmitted from the measuring unit 2 to the signal processing unit 4 is indicated by number 12, and the data transmitted from the signal processing unit 4 to the signal analyzing unit 5 is indicated by number 13. In an embodiment of the invention, the signal analyzing unit 5 contains a neural network algorithm which classifies the sets of characteristics according to whether they remain within the tolerances of normal operation. Faults developing gradually are detected as early as possible. A memory placed in the door system or in some other suitable location contains programmed expert information about which components, such as e.g. door coupler, door lock etc., of the door mechanism should be active at any given phase of the opening and closing process of the door. Abnormal operation detected by utilizing the programming information mentioned in the preceding sentence can be traced as for certain door components.

Figure 2:
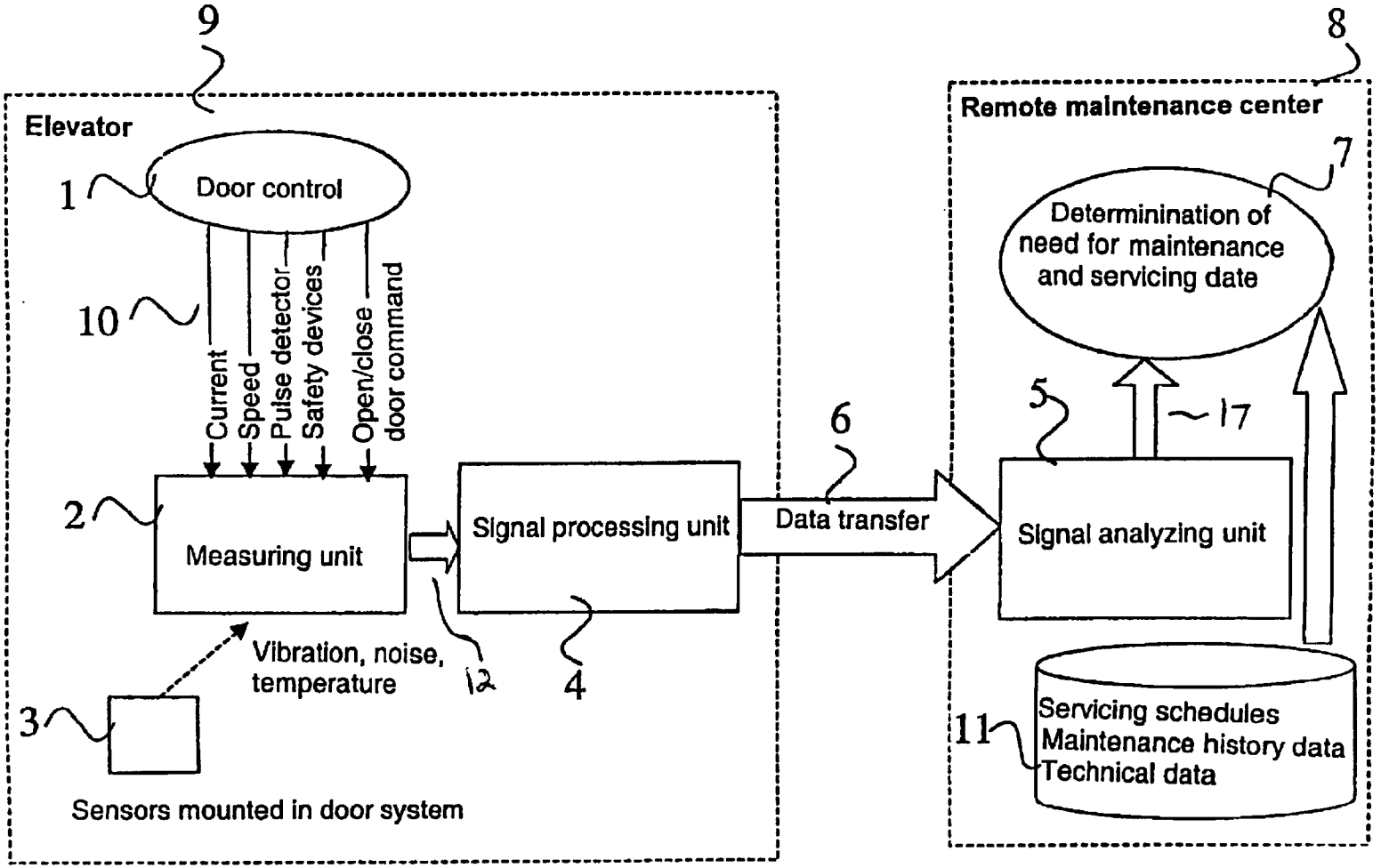
FIG. 2 presents an alternative configuration wherein condition monitoring signals are analyzed in a remote maintenance center.

FIG. 2 presents an example of an alternative composition of the door mechanism, with one or more external sensors 3 added to the door mechanism to measure its vibrations, noise and temperature. These sensors (3) have been installed to make it possible to implement additional measurements that are necessary in determining the condition of the door and its need for maintenance. The data transmitted from the measuring unit 2 to the signal analyzing unit 4 is indicated by number 12 and likewise the data transmitted from the signal analyzing unit 5 to the unit 7 determining the need for maintenance and the time of a servicing visit is indicated by number 17. Acceleration sensors are used in monitoring the condition of a megatronic apparatus to measure the quality of the lateral movement of the elevator door. Acceleration sensors have been conventionally used in monitoring the condition of rotating machines, typically to carry out measurements in the region of bearings. In this configuration, the signal analyzing unit 5 is located in the remote maintenance center 8. The transmission 6 of information from the elevators to the remote maintenance center 8 is effected using known methods and a telephone line or a wireless connection. When information is sent from the elevator to the remote maintenance center 8 for analysis, the data can be transmitted e.g. in connection with a test call on an emergency telephone line. If the results of signal analysis are sent to the remote maintenance center 8 as in the configuration presented in FIG. 1, the data can be transmitted when the values of the characteristics differ from the normal values beyond an allowed limit.

The unit 7 determining the need for maintenance and a servicing date decides, based on the door diagnosis, a date by which the doors of each elevator should be serviced to avoid malfunctions and to guarantee an acceptable level of performance and safety of the elevator. This data is compared to a preliminary servicing visit schedule stored in the database of the remote maintenance center 8. If necessary, an earlier date is assigned for a scheduled servicing visit. For the servicing visit, instructions regarding the doors are generated from the information produced by the diagnostics as to which parts need servicing. Placed in the unit 7 determining the need for maintenance and the servicing date are, among other things, the servicing schedules, servicing history data and technical data 11.

Figure 3:
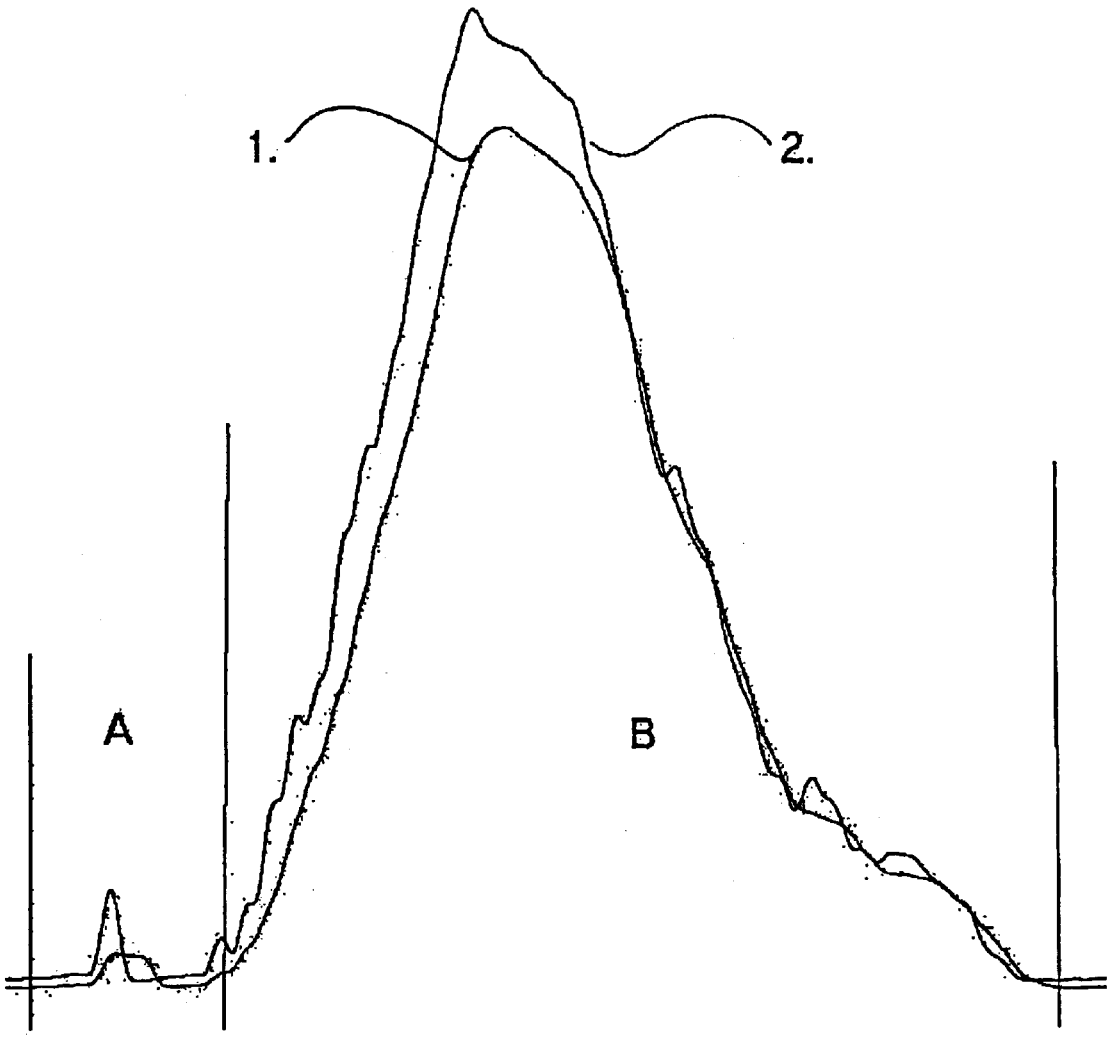
FIG. 3 presents two elevator door operation curves as current/time functions, representing door operation in a normal situation and in a failure situation.

FIG. 3 presents a curve representing the opening movement of an elevator door. Curve 1 is a normal operation curve and curve 2 represents door operation in the case of a malfunction. Door operation curves are curves descriptive of door operation, generated from a signal measured during operation of the door. The situation in FIG. 3 represents the opening movement of the door. The operation curve indicated by number 2 represents door operation as measured during operation of the door, and it can be compared to the curve 1 for normal operation. The portions A and B delimited by vertical lines represent a division of the operation into two stages. Portion A represents operation associated with the unlocking of the door. Portion B represents the phases of acceleration of the door opening movement, constantspeed door opening movement, deceleration of the door opening movement and stopping. The operation curve may also be divided into several different stages. From the shape of operation curve 2, it is possible to infer what faults the elevator door has, such as faults due to e.g. dirt, wear and changed adjustments. From the position and shape of the deviation in operation curve 2 on the time axis, it is possible to infer which part of the door mechanism is faulty.

It is obvious to the person skilled in the art that the invention is not limited to the examples described above, but that it may be varied within the scope of the claims presented below.

What is claimed is:

1. A method for monitoring the condition of the door mechanism of an elevator and determining need for maintenance, said door mechanism comprising a door actuating system, door panels and a door operator, the method comprising the steps of:

measuring the signals of the control system of a door in good condition and generating a set of characteristics descriptive of the operation of the door from them;

measuring the signals of the door control system;

dividing the operation during the opening and closing movements of the door into stages according to which parts of the door are functioning at each stage;

from the measured signals, generating a set of characteristics descriptive of the operation of the door;

comparing the set of characteristics thus generated to the set of characteristics for a normal operating condition stored in memory;

based on the comparison of the two sets of characteristics, performing a diagnosis to determine where and how the operation of the door and its components deviates from normal operation and determining a degree of deviation such that both failures of operation and non-optimal operation prior to failures can be determined; and utilizing the result of the diagnosis to establish the need for servicing and a servicing time.

2. The method as defined in claim 1, wherein the control of the door is monitored by a door control computer which contains a controller of the door operator.

3. The method as defined in claims 1 or 2, wherein a measuring unit measuring the signals of the door control system is built in the door operator or installed on the car of the elevator as a separate unit which receives the measurement data from the door operator.

4. The method as defined in claim 1, wherein, in a signal processing unit placed in the elevator, sets of characteristics descriptive of the operation of the door are generated by distinguishing from the measured signal amplitudes corresponding to frequency bands or frequencies or by observing the signal amplitude in the time domain.

5. The method as defined in claim 1 wherein a signal processing unit compares the set of characteristics generated from the measurement to the set of characteristics for a normal operating condition and is built in the door operator or as a separate unit in the car of the elevator or it may also be placed in a remote maintenance center.

6. The method as defined in claim 1, wherein, in a unit for determining the servicing need, which unit is placed in a remote maintenance center, a decision about a servicing visit is made on the basis of the door diagnosis and the door components requiring servicing are located.

7. The method as defined in claim 1, wherein the transmission of door data is implemented using a telephone line or a wireless connection.

8. The method as defined in claim 1, wherein the transmission of door data is implemented using a telephone line test call to the remote maintenance center.

9. The method as defined in claim 1, wherein an external sensor placed in the door mechanism measures the vibrations, noise and temperature of the door mechanism.

10. The method as defined in claim 1, wherein door operation data, data about the building and door history data are stored in a remote maintenance center.

11. The method as defined in claim 1, wherein an operation curve for a normal door condition and an operation curve for a malfunction situation are compared to each other and, from the position and shape of the deviation in operation curve, an inference is made as to which part of the door of the elevator is faulty.

12. The method as defined in claim 4, wherein the signal processing unit compares the set of characteristics generated from the measurement to the set of characteristics for a normal operating condition and is built in the door operator or as a separate unit in the car of the elevator or it may also be placed in a remote maintenance center.

13. The method as defined in claim 12, wherein, in a unit for determining the servicing need, which unit is placed in the remote maintenance center, a decision about a servicing visit is made on the basis of the door diagnosis and the door components requiring servicing are located.

14. The method as defined in claim 13, wherein the transmission of door data is implemented using a telephone line or a wireless connection.

15. The method as defined in claim 14, wherein the transmission of door data is implemented using a telephone line test call to the remote maintenance center.

16. The method as defined in claim 15, wherein an external sensor placed in the door mechanism measures the vibrations, noise and temperature of the door mechanism.

17. The method as defined in claim 16, wherein door operation data, data about the building and door history data are stored in a remote maintenance center.

18. The method as defined in claim 17, wherein an operation curve for a normal door condition and an operation curve for a malfunction situation are compared to each other and, from the position and shape of the deviation in operation curve, an inference is made as to which part of the door of the elevator is faulty.

19. The method as defined in claim 10, wherein an operation curve for a normal door condition and an operation curve for a malfunction situation are compared to each other and, from the position and shape of the deviation in operation curve, an inference is made as to which part of the door of the elevator is faulty.

* * * * *